US006944918B1

(12) United States Patent
Woolson et al.

(10) Patent No.: US 6,944,918 B1
(45) Date of Patent: Sep. 20, 2005

(54) RING BINDER CLIP

(75) Inventors: Eric E. Woolson, West Des Moines, IA (US); Gregory E. Peterson, Nevada, IA (US); Roger A. Hargens, Johnston, IA (US)

(73) Assignee: Accu-Mold Corp., Ankeny, IA (US)

( * ) Notice: Subject to any disclaimer, the term of this patent is extended or adjusted under 35 U.S.C. 154(b) by 1 day.

(21) Appl. No.: 10/634,928

(22) Filed: Aug. 5, 2003

(51) Int. Cl.[7] ..... A44B 21/00; B42D 1/00
(52) U.S. Cl. ..... 24/302; 24/298; 24/300
(58) Field of Search ..... 24/300–302, 298, 24/462, 545, 546, 547; 281/20, 28, 29, 37, 281/51; D19/32; 402/73, 80 R

(56) References Cited

U.S. PATENT DOCUMENTS

| | | | | | |
|---|---|---|---|---|---|
| 871,610 | A | * | 11/1907 | Nash | 281/20 |
| 1,337,612 | A | | 4/1920 | Miller | |
| 3,610,411 | A | * | 10/1971 | Coleman | 206/223 |
| 4,524,991 | A | * | 6/1985 | Thomas | 281/20 |
| 4,569,613 | A | | 2/1986 | Thomas | |
| 4,687,226 | A | * | 8/1987 | Rose, Jr. | 281/45 |
| 4,997,207 | A | | 3/1991 | Feldman | |
| 5,398,971 | A | * | 3/1995 | Ayele | 281/20 |
| D366,496 | S | | 1/1996 | Yiu | |
| 5,590,909 | A | * | 1/1997 | Urban et al. | 402/80 R |
| 5,634,666 | A | | 6/1997 | Lee | |
| 5,695,295 | A | | 12/1997 | Ayele et al. | |
| 5,897,141 | A | | 4/1999 | Dugmore et al. | |
| 2003/0129017 | A1 | * | 7/2003 | Morris | 402/73 |

* cited by examiner

*Primary Examiner*—Robert J. Sandy
*Assistant Examiner*—Ruth C. Rodriguez
(74) *Attorney, Agent, or Firm*—McKee, Voorhees & Sease, P.L.C.

(57) ABSTRACT

A clip is provided for use on a loose-leaf binder having a spine with front and back covers and a plurality of rings for holding paper in the binder. The clip includes a U-shaped member having a base and outer legs adapted to engage outer surfaces of the binder covers, and a pair of inner legs extending from the base and being spaced from the outer legs so as to be adapted to engage the inner surfaces of the binder covers. A strap has a first end connected to the base of the U-shaped member and a second end with a loop adapted to be attached to the top binder ring to prevent the clip from becoming lost when detached from the binder. The clip has a small profile, with a width of approximately ¼ inch.

18 Claims, 2 Drawing Sheets

RING BINDER CLIP

BACKGROUND OF THE INVENTION

Ring binders typically include front and back covers interconnected by a spine. Rings to hold loose papers are attached to the spine or to the inside of one of the covers adjacent the spine. The binders normally are wider at the spine than at the opposite open side, unless filled with paper. This design presents challenges to orderly storage of the binders, since binders that are filled to less than capacity have a somewhat triangular footprint. Thus, standing alone, a partially-filled binder will fall over and rest unevenly against a bookend or other binders. Secondly, when multiple binders are assembled, the triangular footprint begins to create a semi-circle. This curvature of the grouped binders causes the binders in the middle to be squeezed out of line and binders on the ends to assume positions at angles of less than or more than 90°, thereby making it more difficult to locate individual binders.

Various devices have been proposed for attaching to binders to hold the covers parallel to one another, thereby creating a more stable rectangular footprint. However, such devices generally have been bulky, complex in structure, or time consuming to attach and detach.

Therefore, a primary objective of the present invention is the provision of an improved ring binder clip which stabilizes the binder on a shelf or other support surface.

Another objective of the present invention is the provision of an improved ring binder clip which can be quickly and easily attached and detached to a ring binder.

A further objective of the present invention is the provision of a ring binder clip which holds the covers of a ring binder parallel to one another and at 90° angles to the binder spine.

Still another objective of the present invention is the provision of a ring binder clip which transforms the typical triangular footprint of the binder to a rigid rectangular footprint.

Another objective of the present invention is the provision of an improved ring binder clip which is economical to manufacture and durable in use.

These and other objectives will become apparent from the follow description of the invention.

SUMMARY OF THE INVENTION

The ring binder clip of the present invention is designed for use with a ring binder having front and back covers and an interconnecting spine. The clip includes a bar or base with a pair of closely spaced legs at each end of the base. The legs are adapted to mount onto the front and back covers of the ring binder and hold the cover parallel to one another, thereby creating a rectangular footprint. The length of the bar is substantially equal to the width of the ring binder spine. The legs are parallel to one another, and at least some of the legs include a rib or ridge to enhance frictional engagement to the binder covers. A retaining strap is provided, with a first end attached to the bar and a second end having a loop adapted to be attached to one of the rings of the binder.

DETAILED DESCRIPTION OF THE PREFERRED EMBODIMENT

Figure 1:
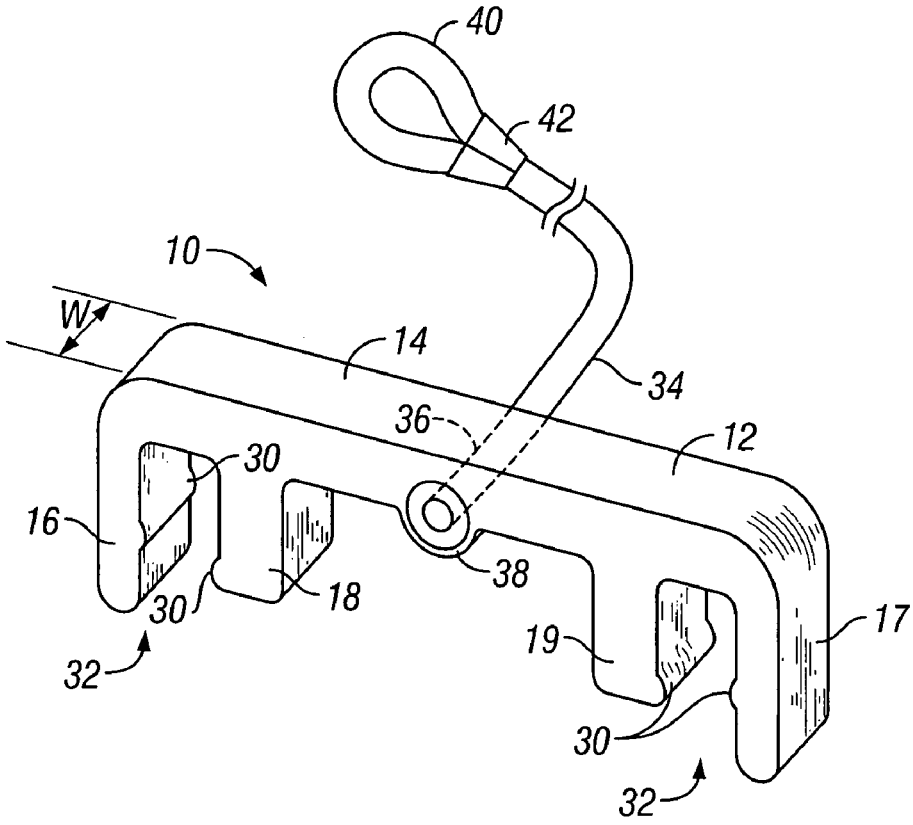
FIG. 1 is a perspective view of the ring binder clip of the present invention.

The binder clip of the present invention is generally designated by the reference numeral 10 in the drawings. The clip 10 includes a U-shaped member 12 defined by a base or bar 14 with outer legs 16, 17 extending perpendicularly at each end of the bar. A pair of inner legs 18, 19 also extend perpendicularly from the bar 14. Thus, the outer leg 16 and inner leg 18 form a first pair of mounting legs, while outer leg 17 and inner leg 19 form a second pair of mounting legs. The legs 16–19 are parallel to one another, and are substantially rigid. The clip 10 has a length defined by the outer legs 16, 17 and a width W, as seen in FIG. 1.

Figure 3:
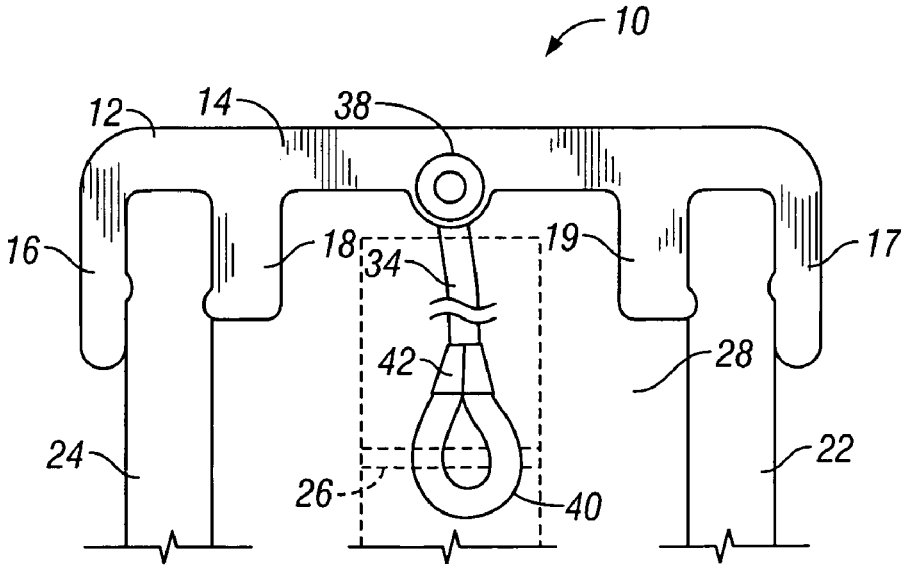
FIG. 3 is an elevation view of the clip mounted on the binder.
Figure 2:
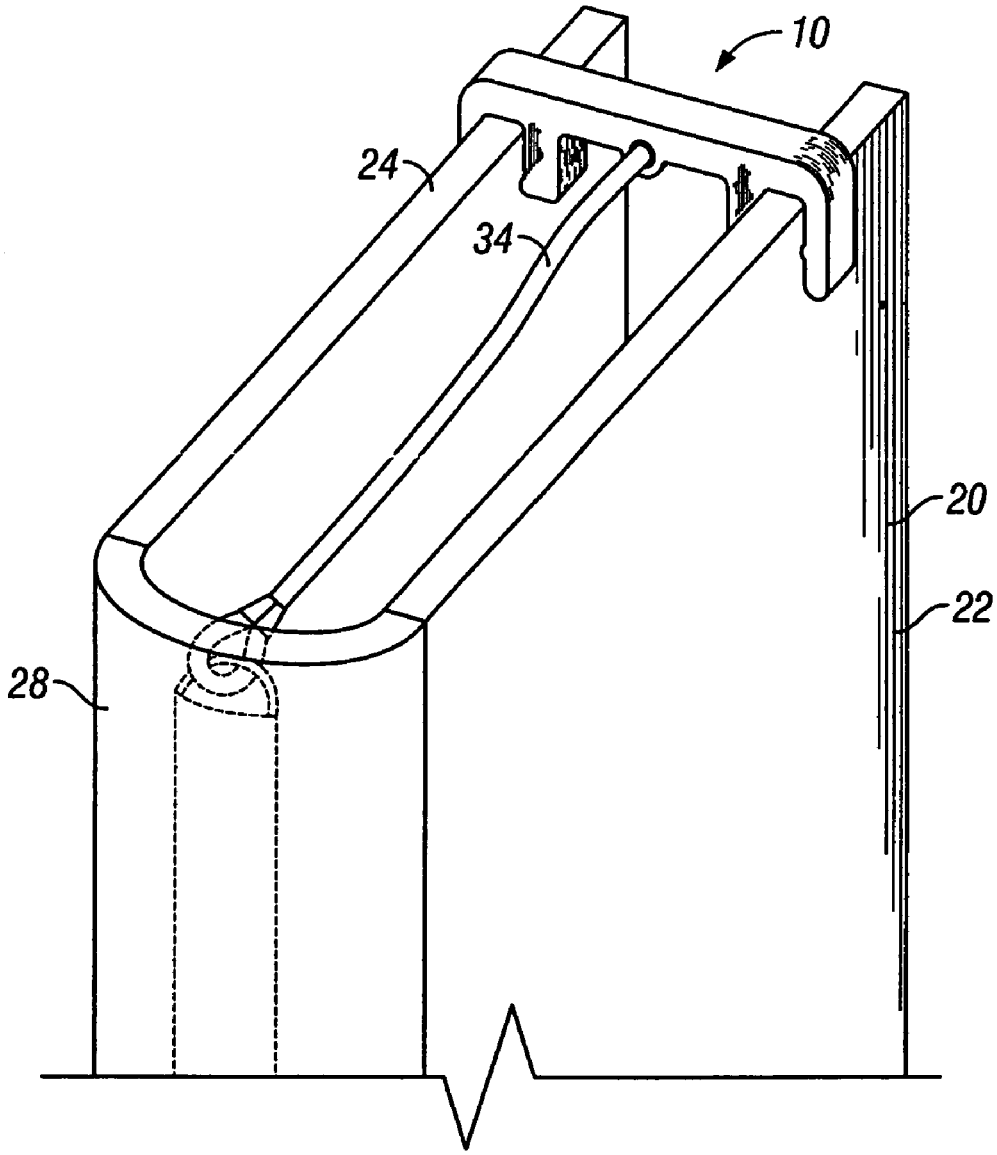
FIG. 2 is a perspective view of the clip mounted on a binder.

As seen in FIGS. 2 and 3, the clip 10 is adapted to mount onto a ring binder 20. The binder 20 includes a front cover 22 and a back cover 24. The binder 20 also includes a plurality of rings 26 adapted to hold papers punched with holes corresponding to the rings 26. In the drawings, the rings 26 are shown to be mounted on the spine 28 of the binder 20. However, it is understood that the rings 26 may also be mounted on the inside of one of the covers 22, 24 adjacent the spine 28. The construction of the binder 20 is conventional, and does not constitute part of the present invention.

One or more of the legs 16–19 include a rib or ridge 30 which enhances the frictional engagement between the respective legs and covers 22, 24. The space 32 between the legs 16, 18 and between legs 17, 19 is substantially equal to the thickness of the binder covers 22, 24.

A retaining strap 34 is provided so that the clip 10 is connected to the binder 20 and not lost. The strap 34 extends through a hole 36 in the bar 14 of the clip 10. The first end of the strap 34 includes an enlarged head 38 so that the strap 34 will not pull through the hole 36 of the clip 10. The second end of the strap 34 includes a loop 40 adapted to extend around one of the rings 26 of the binder 20. The loop 40 is formed by a clamp or crimp piece 42 adjacent the second end of the strap 34.

Preferably, the clip 10 is injection molded. The bar 14 has a length substantially equal to the width of the spine 28 of the binder 20. The clip can be manufactured in various sizes to correspond with and accommodate the various binder sizes, such as ½ inch, ¾ inch, one inch, two inches, three inches, and four inches. The legs 16–19 are approximately ¼ inch long. The space 32 between the legs 16, 18 and 17, 19 is approximately ⅛ inch. Preferably, the width of the clip 10 is ¼ inch, and no more than ½ inch. Thus, a very small clip 10 is provided for holding the covers 22, 24 of the binder in a parallel relationship to form the stable rectangular footprint.

Preferably, the clip 10 is mounted on the top edge of the binder 20. However, it is understood that the clip 10 can also be used on the front or open edge of the binder 20. The small size of the clip 10 allows it to be attached and detached quickly and easily to and from the binder 20, while the strap 34 connected to the top ring 26 of the binder 20 prevents the clip 10 from becoming lost when detached from the binder covers 22, 24.

Whereas the invention has been shown and described in connection with the preferred embodiment thereof, it will be understood that any modifications, substitutions, and additions may be made which are within the intended broad scope of the following claims. From the foregoing, it can be seen that the present invention accomplishes at least all of the stated objectives.

What is claimed is:

1. A ring binder clip for use with a ring binder having front and back covers and an interconnecting spine, comprising:

a bar having opposite ends and having a length substantially equal to the width of the ring binder spine;

a first pair of legs extending from one end of the bar;

a second pair of legs extending from the other end of the bar;

the first and second pairs of legs being adapted to frictionally mount onto the front and back covers of the ring binder so as to create a rectangular footprint for the binder; and a strap having a first end attached to the bar and a second end adapted to be attached to the binder.

2. The ring binder clip of claim 1 wherein the legs are parallel to one another.

3. The ring binder clip of claim 1 wherein the legs are substantially rigid.

4. The ring binder clip of claim 1 wherein at least one leg of each pair includes a rib to increase friction with the respective front and ear covers.

5. The ring binder clip of claim 1 wherein the strap extends through a hole in the bar.

6. The ring binder clip of claim 1 wherein the second end of the strap includes a loop to extend around a ring of the binder.

7. The ring binder clip of claim 1 wherein the clip is adapted to fit on a top edge of the covers.

8. The ring binder clip of claim 1 wherein the bar has a width of no more than ¼ inch.

9. The ring binder clip of claim 1 wherein the clip is made by injection molding.

10. A clip for use on a loose-leaf binder having a spine with front and back covers extending from the spine, the clip comprising:

a U-shaped member having a base and outer legs adapted to engage outer surfaces of the binder covers;

a pair of inner legs extending from the base and being spaced inwardly from the outer legs so as to be adapted to engage inner surfaces of the binder covers;

the U-shaped member having a length defined by the outer legs and a width less than the length; and further comprising a strap connected to the U-shaped member and being adapted to connect to the binder to retain the clip to the binder when the inner and outer legs are disengaged from the cover.

11. The clip of claim 10 wherein the strap includes a loop at one end adapted to extend around a ring of the binder.

12. The clip of claim 10 wherein the base has a hole through which the strap extends.

13. The clip of claim 10 wherein the inner and outer legs are parallel to one another.

14. The clip of claim 10 wherein the inner and outer legs are substantially rigid.

15. The clip of claim 10 wherein at least some of the inner and outer legs include ribs to enhance retentions of the clip on the binder covers.

16. The clip of claim 10 wherein the width of the U-shaped member is no more than ½ inch in width.

17. The clip of claim 10 wherein the U-shaped member and inner legs have an integral construction.

18. The clip of claim 10 wherein the U-shaped member is injection molded.

* * * * *